US008308229B2

(12) United States Patent
Galley

(10) Patent No.: US 8,308,229 B2
(45) Date of Patent: Nov. 13, 2012

(54) STRAP MANAGEMENT SYSTEM FOR INFANT SUPPORT STRUCTURE

(75) Inventor: Seth Galley, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 363 days.

(21) Appl. No.: 12/692,775

(22) Filed: Jan. 25, 2010

(65) Prior Publication Data

US 2010/0201164 A1 Aug. 12, 2010

Related U.S. Application Data

(60) Provisional application No. 61/150,739, filed on Feb. 7, 2009.

(51) Int. Cl.
*A47C 13/00* (2006.01)

(52) U.S. Cl. .... 297/130; 297/118; 297/134; 297/256.16

(58) Field of Classification Search ..... 297/118, 297/130, 134, 256.16
See application file for complete search history.

(56) References Cited

U.S. PATENT DOCUMENTS

| | | | | |
|---|---|---|---|---|
| 2,580,935 | A | 1/1952 | Lovelace | |
| 4,113,306 | A * | 9/1978 | von Wimmersperg | 297/216.11 |
| 4,291,915 | A | 9/1981 | Cox | |
| D357,129 | S | 4/1995 | Tiramani | |
| 5,558,400 | A * | 9/1996 | Poulson et al. | 297/344.18 |
| 5,676,386 | A | 10/1997 | Huang | |
| 5,704,684 | A | 1/1998 | Dukatz et al. | |
| 5,890,762 | A * | 4/1999 | Yoshida | 297/256.13 |
| 5,947,556 | A * | 9/1999 | Strojny | 297/256.16 |
| 5,951,102 | A * | 9/1999 | Poulson et al. | 297/130 |
| 6,050,643 | A * | 4/2000 | Kain et al. | 297/344.18 |
| 6,089,653 | A * | 7/2000 | Hotaling et al. | 297/130 |
| 6,318,807 | B1 * | 11/2001 | Perego | 297/440.22 |
| 6,343,837 | B1 | 2/2002 | Gage | |
| 6,511,123 | B1 * | 1/2003 | Sitarski et al. | 297/130 |
| 6,832,813 | B2 | 12/2004 | Tomas et al. | |
| 6,863,345 | B2 | 3/2005 | Kain | |
| 7,300,103 | B1 | 11/2007 | Grays | |
| 7,673,934 | B2 * | 3/2010 | Bearup et al. | 297/130 |
| 8,029,053 | B2 * | 10/2011 | Troutman et al. | 297/148 |
| 2003/0193226 | A1 | 10/2003 | Kain | |
| 2007/0241596 | A1 | 10/2007 | Merrill | |

* cited by examiner

*Primary Examiner* — Laurie Cranmer
(74) *Attorney, Agent, or Firm* — Edell, Shapiro & Finnan, LLC

(57) ABSTRACT

The disclosed invention relates to an infant support structure. In particular, the invention relates to a strap management system for an infant support structure. In addition, the invention relates to an infant support structure that includes a seat portion that can be used alternatively as a booster seat and with a frame as part of a highchair.

20 Claims, 16 Drawing Sheets

STRAP MANAGEMENT SYSTEM FOR INFANT SUPPORT STRUCTURE

CROSS-REFERENCE TO RELATED APPLICATION

This application claims priority to and the benefit of U.S. Provisional Patent Application No. 61/150,739, filed Feb. 7, 2009, entitled "Strap Management System for Infant Support Structure," the entire disclosure of which is incorporated herein by reference in its entirety.

FIELD OF THE INVENTION

The invention relates to an infant support structure. In particular, the invention relates to a strap management system for an infant support structure. In addition, the invention relates to an infant support structure that includes a seat portion that can be used alternatively as a booster seat and with a frame as part of a highchair.

BACKGROUND OF THE INVENTION

Conventional infant support structures provide support for a child or infant. Some examples of such infant support structures include, but are not limited to, seats, booster seats, infant seats, and high chairs. Sometimes a parent or caregiver desires to use a particular seat or booster seat with different support structures.

Depending on the different support structures, the manner in which the seat is used with a support structure varies. In one implementation, a seat can be coupled to a frame that is supported on the ground. In another implementation, a seat is coupled to a support structure such as a chair and one or more straps are used to couple the seat to the chair. To the extent that straps extend from the seat, when the seat is to be coupled to a frame, the straps may interfere with the coupling between the seat and the frame.

Therefore, there is a need for an infant support structure that facilitates the different uses of the structure with different supports. The need also exists for an infant support structure that has a strap or coupler system that is easily used and does not interfere with the use of the seat.

SUMMARY OF THE INVENTION

In one embodiment, the invention relates to a child seat system that includes a frame configured to be placed on a support surface, the frame including a mounting portion and a seat. The seat being useable in a stand-alone mode and being removably coupleable to the frame in a high chair mode. The seat includes a strap coupled to the seat, the strap being configured to be used to couple the seat to a support other than the frame, and a compartment. The strap is placeable in the compartment and the compartment has an opening through which the strap can extend. The seat includes a mounting portion, the mounting portion of the seat being configured to engage the mounting portion of the frame to couple the seat to the frame, and a closure member being movable relative to the opening of the compartment between a closed position and an open position. The closure member in the closed position covering the opening of the compartment. The closure member in the open position being spaced from the opening and preventing the mounting portion of the seat from engaging the mounting portion of the frame to couple the seat to the frame.

In one embodiment, the closure member is a door that is slidably mounted to the seat, and the door maintains the strap in the compartment when the door is in its closed position. The frame includes a first side portion and a second side portion and the mounting portion of the frame includes a first mounting member and a second mounting member. Each of the first mounting member and the second mounting member is coupled to the first side portion and the second side portion and extending between the first side portion and the second side portion.

In one embodiment, the first mounting member is a first elongate member, the second mounting member is a second elongate member, and the mounting portion of the seat includes a first slot and a second slot. The first slot receives the first elongate member and the second slot receives the second elongate member when the seat is mounted on the frame. In another embodiment, the mounting portion of the seat includes a first side portion and a second side portion. Each of the first side portion and the second side portion includes a first slot and a second slot, and the closure member blocks the first slots when the closure member is in its open position and the closure member does not block the first slots when the closure member is in its closed position. In one embodiment, the mounting portion of the frame includes a first bar and a second bar, and the first slots being configured to receive the first bar, and the second slots being configured to receive the second bar.

In one embodiment, the invention relates to a reconfigurable chair assembly that includes a frame portion, the frame portion being configured to engage a support surface, and a seat portion, the seat portion being removable from and connectable to the frame portion. The seat portion includes a chamber with an opening, a cover movable between an open position spaced from the opening and a closed position covering the opening, and a strap portion. The strap portion is configured to connect the seat portion to an object other than the frame portion, and the strap portion is locatable in the chamber and maintained therein by the cover. The seat portion is prevented from being connected to the frame portion unless the strap portion is in the chamber.

In alternative embodiments, when the strap portion extends from the chamber, the cover is not movable to its closed position. In addition, the seat portion is not connectable to the frame portion when the cover is in its open position. The frame portion may include a mounting portion, the seat portion may include a mounting portion, and the mounting portion of the frame portion is configured to engage the mounting portion of the seat portion to couple the seat portion to the frame portion, and the cover of the seat portion is positioned proximate to the mounting portion of the seat. In one embodiment, the mounting portion of the seat portion is rendered inoperable when the cover is placed in its opened position. The mounting portion of the frame may include at least one elongate member, and the mounting portion of the seat may include at least one recess configured to receive the at least one elongate member. In another embodiment, the cover blocks the at least one recess when the cover is placed in its opened position.

In one embodiment, the invention relates to an infant support structure that includes a high chair frame, and a booster seat. The booster seat includes a strap configured to couple the booster seat to a support, and the booster seat is removably coupleable to the high chair frame. The booster seat has a first configuration in which the booster seat can be coupled to the high chair frame and a second configuration in which the booster seat is prevented from being coupled to the high chair frame. The high chair frame includes a mounting portion and the booster seat includes a mounting portion, and the mounting portion of the booster seat is prevented from engaging the mounting portion of the high chair frame when the booster seat is in its second configuration. The booster seat may include a strap system that is configured to store the strap and to allow access to the strap. The strap system stores the strap when the booster seat is in its first configuration and allows access to the strap when the booster seat is in its second configuration.

In one embodiment, the strap system includes a storage compartment with a cover, the cover being in a closed position in the first configuration and in an open position in the second configuration. In one embodiment, the cover is spaced apart from the mounting portion of the booster seat in the first configuration and blocks the mounting portion of the booster seat in the second configuration. The high chair frame includes a first elongate member and a second elongate member, and the seat includes a first recess configured to receive the first elongate member and a second recess configured to receive the second elongate member. The cover blocks the first recess when the cover is placed in its open position.

BRIEF DESCRIPTION OF THE DRAWINGS

Like reference numerals have been used to identify like elements throughout this disclosure.

DETAILED DESCRIPTION OF THE INVENTION

The terms "support" or "support structure" are used to refer to any frame or support that is configured to provide support for an object. The term "infant support structure" can be used to refer to any frame or support that can be used to support an infant in a stationary manner or in a moving manner. Some exemplary infant support structures are swings, bassinets, playards, cribs, jumping devices, bouncers, high chairs, etc. The terms "child" and "infant" may be used interchangeably herein.

Figure 1:
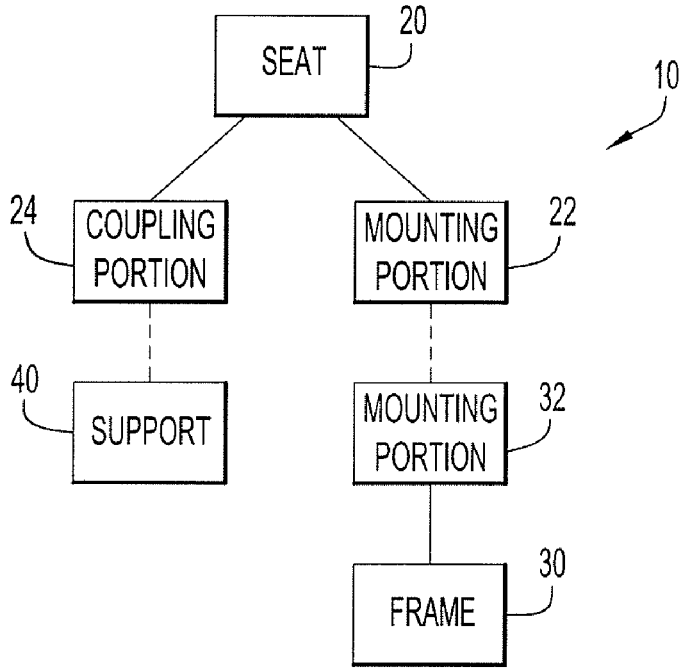
FIG. 1 illustrates a schematic block diagram of an embodiment of an infant support structure according to the invention.

Referring to FIG. 1, an embodiment of an infant support structure according to the invention is illustrated. The infant support structure 10 includes a seat 20. The seat 20 can be formed of one or more pieces and is configured to receive an infant or child thereon. In one embodiment, the seat 20 includes a mounting portion 22 and a coupling portion 24. As represented in FIG. 1, the mounting portion 22 is configured to engage a mounting portion 32 of a frame 30 to couple the seat 20 to the frame 30. The mounting portion 22 is adjustable to allow for the coupling and uncoupling of the seat 20 to the frame 30. In an alternative embodiment, the mounting portion 32 of the frame 30 is adjustable to facilitate the decoupling of the seat 20 from the frame 30. In different embodiments, the frame 30 can be a stationary frame or a moving frame. In one embodiment, the frame 30 can be a high chair frame.

The coupling portion 24 of the seat 20 can be used to mount or couple the seat 20 to a support 40 other than the frame 30. For example, the support 40 can be a chair or bench to which the seat 20 can be coupled by the coupling portion 24. In one embodiment, the coupling portion 24 includes several straps or strap portions that can be wrapped around or through a portion of the support 40.

Figure 2:
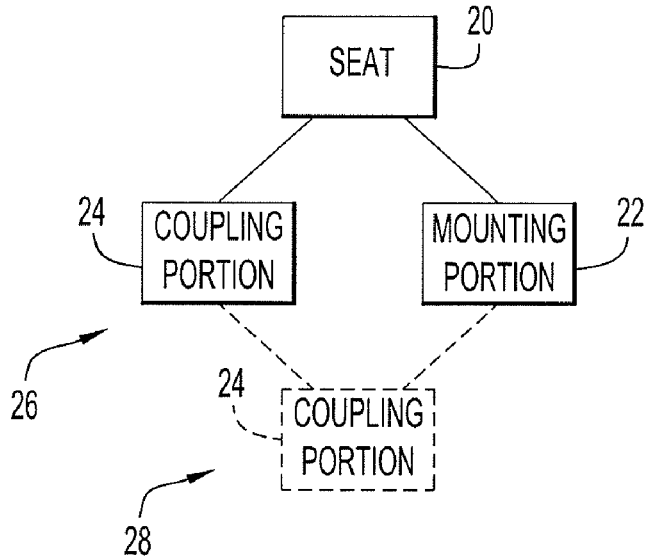
FIG. 2 illustrates a schematic block diagram of the infant support structure illustrated in FIG. 1 in different configurations.

Referring to FIG. 2, in one embodiment, the coupling portion 24 can be placed in different positions or configurations. In particular, the coupling portion 24 can be placed in one position 26 relative to the seat 20 and can be moved to another position 28 relative to the seat 20. In position 28, the coupling portion 24 interacts with the mounting portion 22 of the seat 20 and affects the use of the mounting portion 22. In one example, the coupling portion 24 in position 28 may prevent the mounting portion 22 of the seat 20 from being coupled to the mounting portion 32 of the frame 30. In that example, the coupling portion 24 may render the mounting portion 22 of the seat 20 inoperable until the coupling portion 24 is returned to position 26. Accordingly, the seat 20 cannot be coupled or mounted to the frame 30 unless the coupling portion 24 is in a particular position or configuration.

Figure 3:
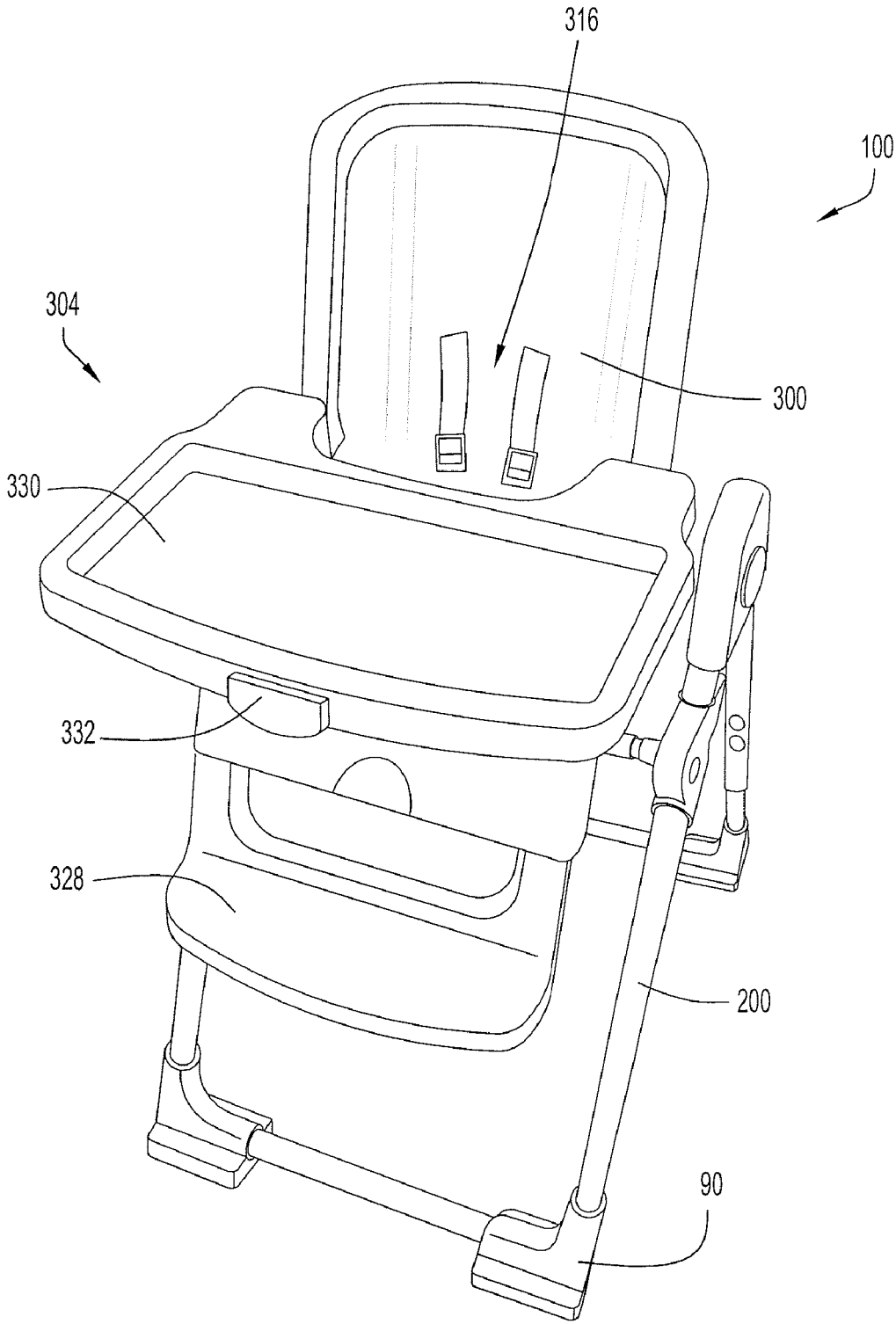
FIG. 3 illustrates a perspective view of an embodiment of an infant support structure according to the invention.

Referring to FIG. 3, an embodiment of an infant support structure according to the invention is illustrated. In this embodiment, the infant support structure 100 is a high chair that can be placed on a support surface 90. The infant support structure 100 can be referred to alternatively as a child seat system or chair assembly as well. In alternative embodiments, the infant support structure may be a swing or other structure configured to support an infant or child.

As shown in FIG. 3, the infant support structure 100 includes a frame 200 that is configured to be supported on the support surface 90. The infant support structure 100 also includes a seat or seat portion 300 that is coupled to the frame 200. The seat 300 includes a child receiving area or portion 316 in which a child or infant can be placed and a footrest 328. Coupled to the seat 300 is a tray 330 with an actuator 332 that can be manipulated to release the tray 330 from the seat 300. In FIG. 3, the seat 300 is illustrated in a high chair configuration 304.

Figure 4:
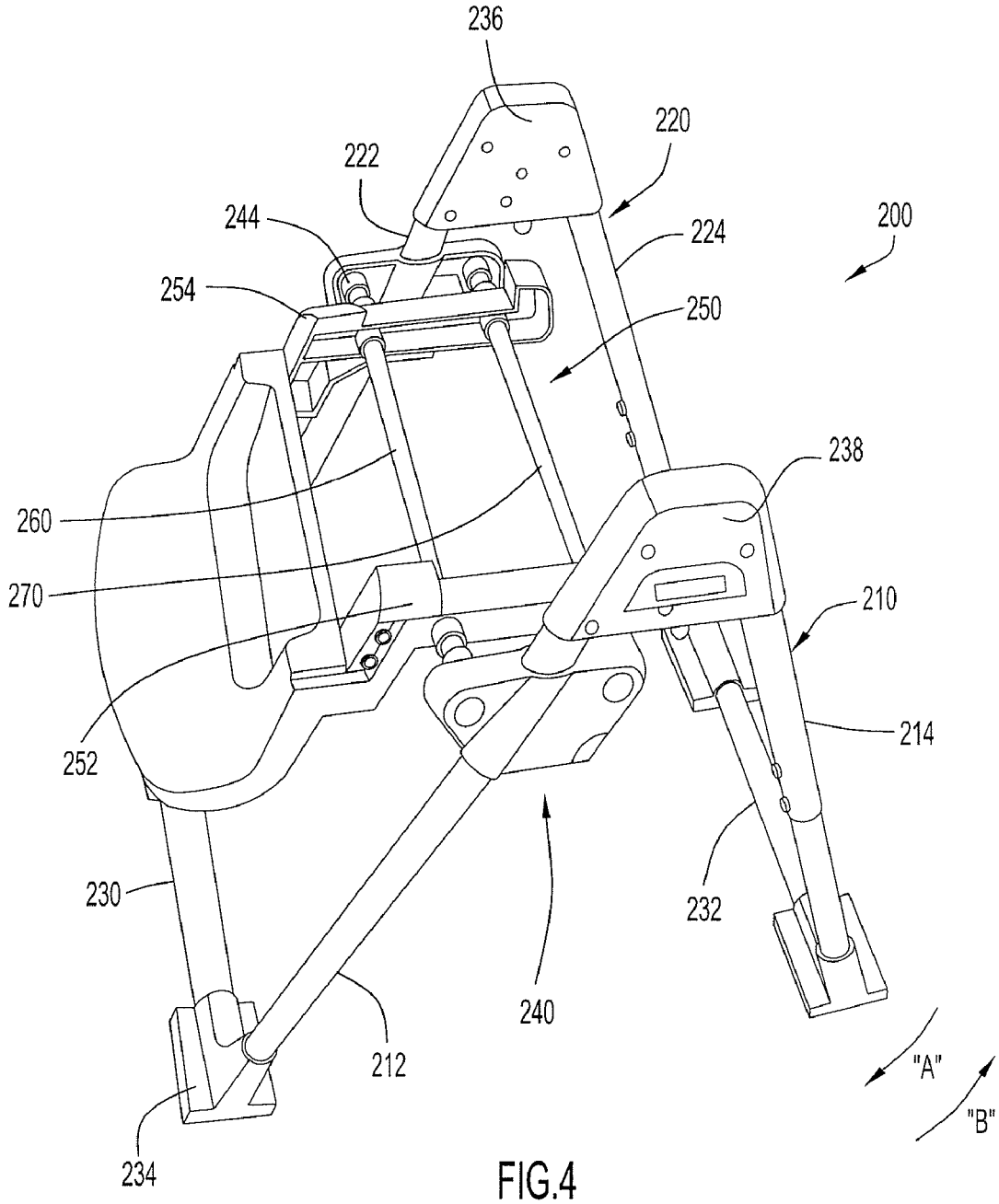
FIG. 4 illustrates a perspective view of the frame of the infant support structure illustrated in FIG. 3.

Referring to FIG. 4, the frame 200 of the infant support structure 100 is illustrated in detail. The frame 200 includes side portions 210 and 220 and lower portions 230 and 232 coupled to the side portions 210 and 220. Side portion 210 includes a front member 212 and a rear member 214. Similarly, side portion 220 includes a front member 222 and a rear member 224. Each of the front members 212 and 222 and the rear members 214 and 224 is an elongate member and can be made of any material, such as a metal, thereby forming a tubular element. Side portion 210 includes a connector or hub 238 to which front member 212 is connected and rear member 214 is pivotally connected. Similarly, side portion 220 includes a connector or hub 236 to which front member 222 is connected and rear member 224 is pivotally connected. The rear members 214 and 224 can be moved along the direction of arrow "A" to collapse the frame 200 and along the direction of arrow "B" to deploy the frame 200. At each of the lower corners of the frame 200 a foot 234 is provided. In different embodiments, the frame 200 may have different configurations, such as a forwardly oriented scoop configuration, a rearwardly oriented scoop configuration, or a box-like configuration.

As shown in FIG. 4, the frame 200 includes a mounting portion 250 to which the seat 300 can be coupled and a height adjustment mechanism 240 that can be used to change the position of the mounting portion 250 relative to a support surface 90. The height adjustment mechanism 240 includes moving members 242 and 244 (see also FIG. 5) that can move along the front frame members 212 and 222. The mounting portion 250 is supported by the moving members 242 and 244 and as a result, the position of the moving members 242 and 244 determines the position of the mounting portion 250 of the frame 200.

The mounting portion 250 includes side members 252 and 254 to which the footrest 328 is coupled. The side members 252 and 254 are coupled to mounting members 260 and 270. The mounting members 260 and 270 are elongate members, such as rods, bars, or tubes, that are formed of metal in one embodiment. In different embodiments, the mounting members 260 and 270 can be made of a different material.

Figure 5:
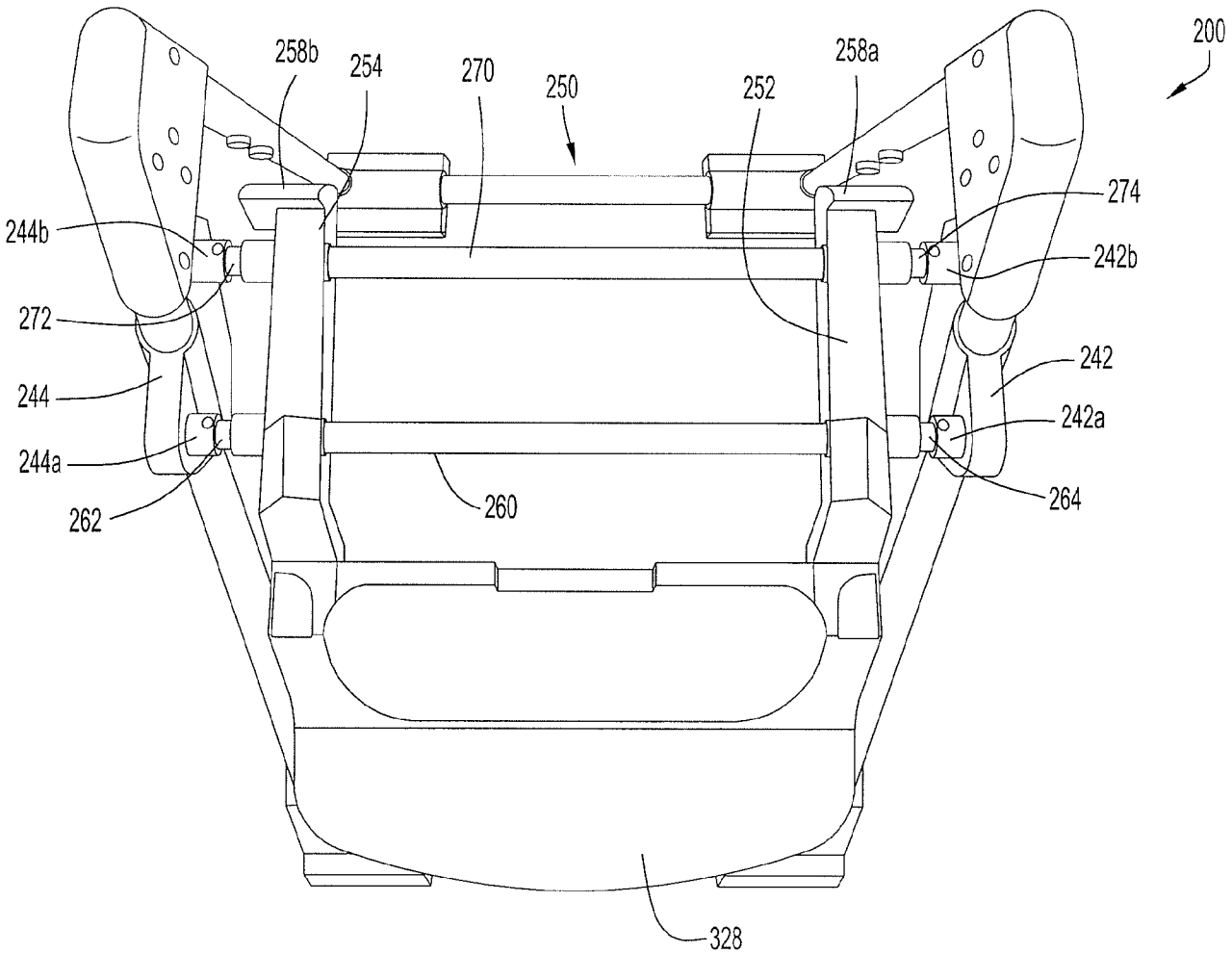
FIG. 5 illustrates a front view of the frame illustrated in FIG. 4.

Referring to FIG. 5, additional components of the mounting portion 250 of the frame 200 are shown. Mounting member 260 has opposite ends 262 and 264 that are engaged with sleeves 244*a* and 242*a*, respectively, on moving members 244 and 242. Similarly, mounting member 270 has opposite ends 272 and 274 that are engaged with sleeves 244*b* and 242*b*, respectively, on moving members 244 and 242. As shown in FIG. 5, mounting members 260 and 270 extend through the side members 252 and 254 of the mounting portion 250. Side members 252 and 254 include extensions 258*a* and 258*b*, respectively, that help with the mounting of the seat 300 to the frame 200.

Figure 6:
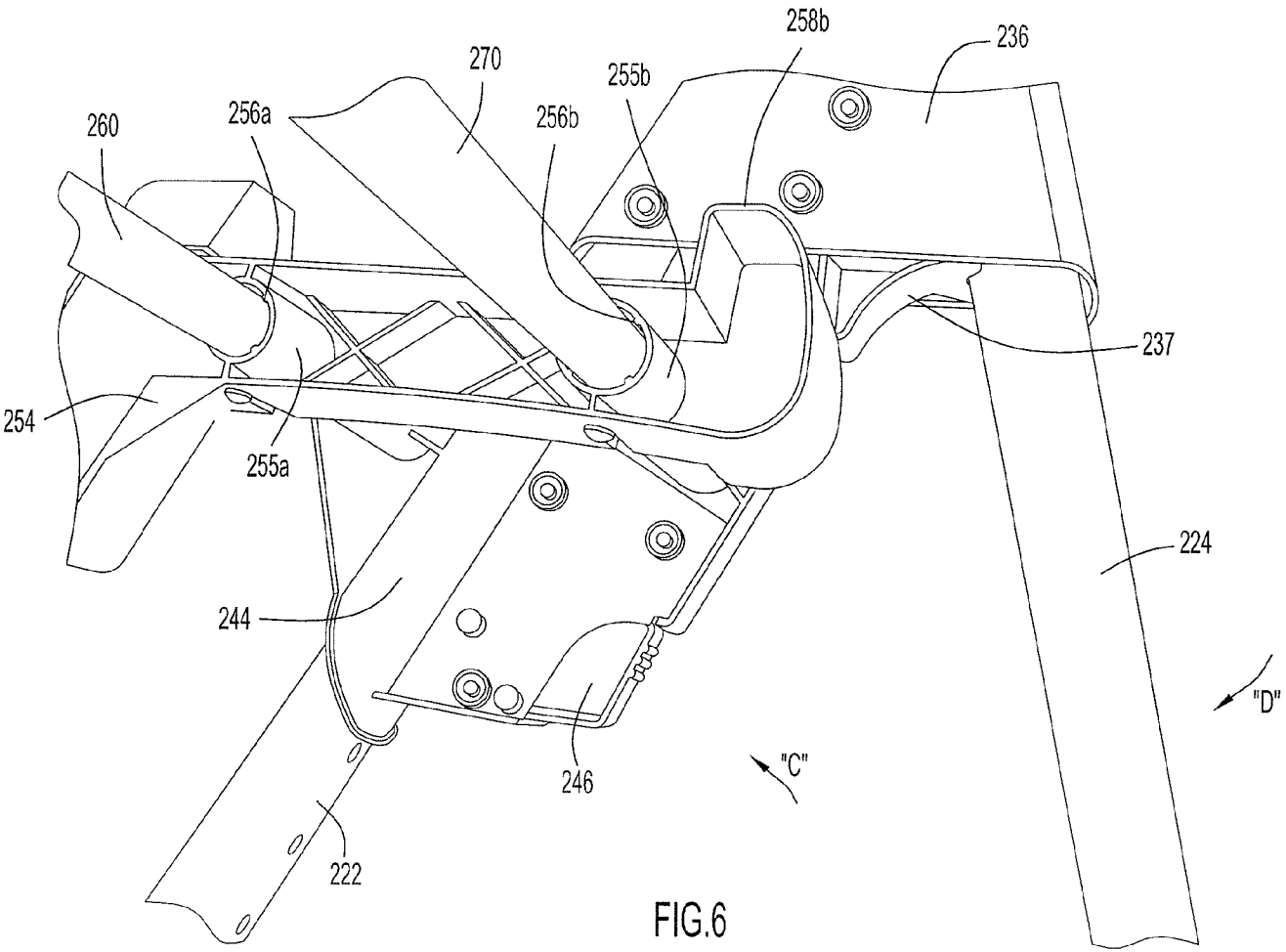
FIG. 6 illustrates a close-up side view of some components of the frame illustrated in FIG. 4.

Referring to FIG. 6, some components of the frame 200 are shown in detail. Front member 222 and rear member 224 are coupled to the connector 236 as shown. A release mechanism 237 can be manipulated to release the rear member 224 from its locked position and allow it to move along the direction of arrow "D" to a collapsed position. Moving member 244 includes a release mechanism 246 that can be moved along the direction of arrow "C" to disengage a projection (not shown) from a corresponding hole or recess in front member 222 to permit the moving member 244 to slide along the front member 222. Moving member 242 includes a similar release mechanism (not shown).

Mounting member 260 extends through an opening 256*a* in sleeve 255*a* of side member 254. Similarly, mounting member 270 extends through an opening 256*b* in sleeve 255*b* of side member 254. Extension 258*b* of side member 254 is illustrated in FIG. 6 as well. In one embodiment, each of the side members 252 and 254 is formed of molded plastic.

Figure 7:
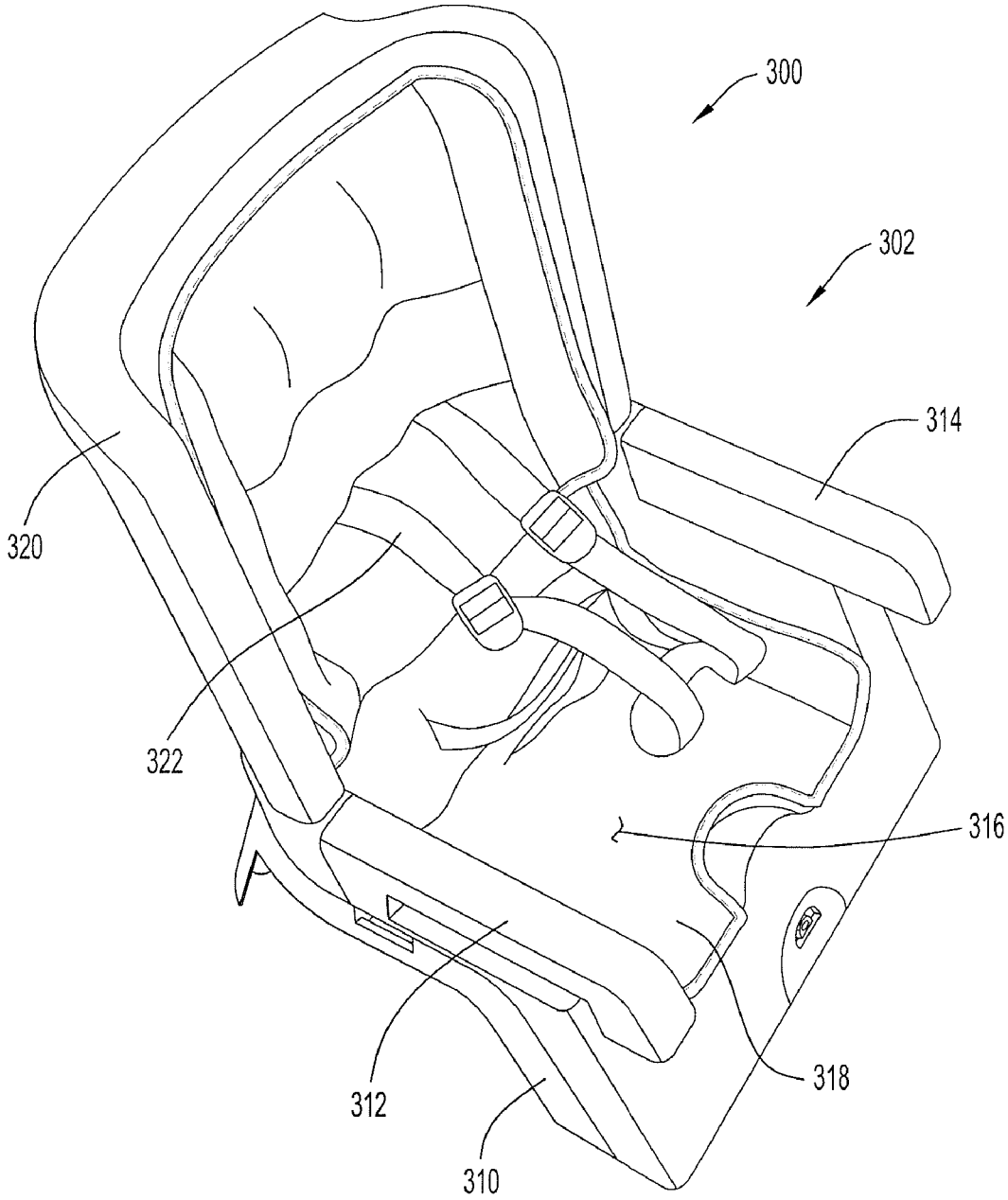
FIG. 7 illustrates a perspective view of a seat portion of the infant support structure illustrated in FIG. 3.

Referring to FIG. 7, an embodiment of a seat according to the invention is illustrated. The seat 300 can be decoupled or removed from the frame 200 and used separately as a booster seat. The seat 300 can be placed on a support, such as a chair or bench, and if desired, coupled to that support, as described below. The seat 300 is shown in a stand-alone configuration 302 in FIG. 7. The seat 300 includes a base 310 with arms 312 and 314 and a back or seatback portion 320. The seat 300 has an infant receiving area or region 316 in which a child or infant can be placed. A softgoods or padded portion 318 is provided with the seat 300 for the comfort of the child or infant. A strap system or assembly 322 is coupled to the seat 300 to allow a parent or caregiver to secure a child in the seat 300.

Figure 8:
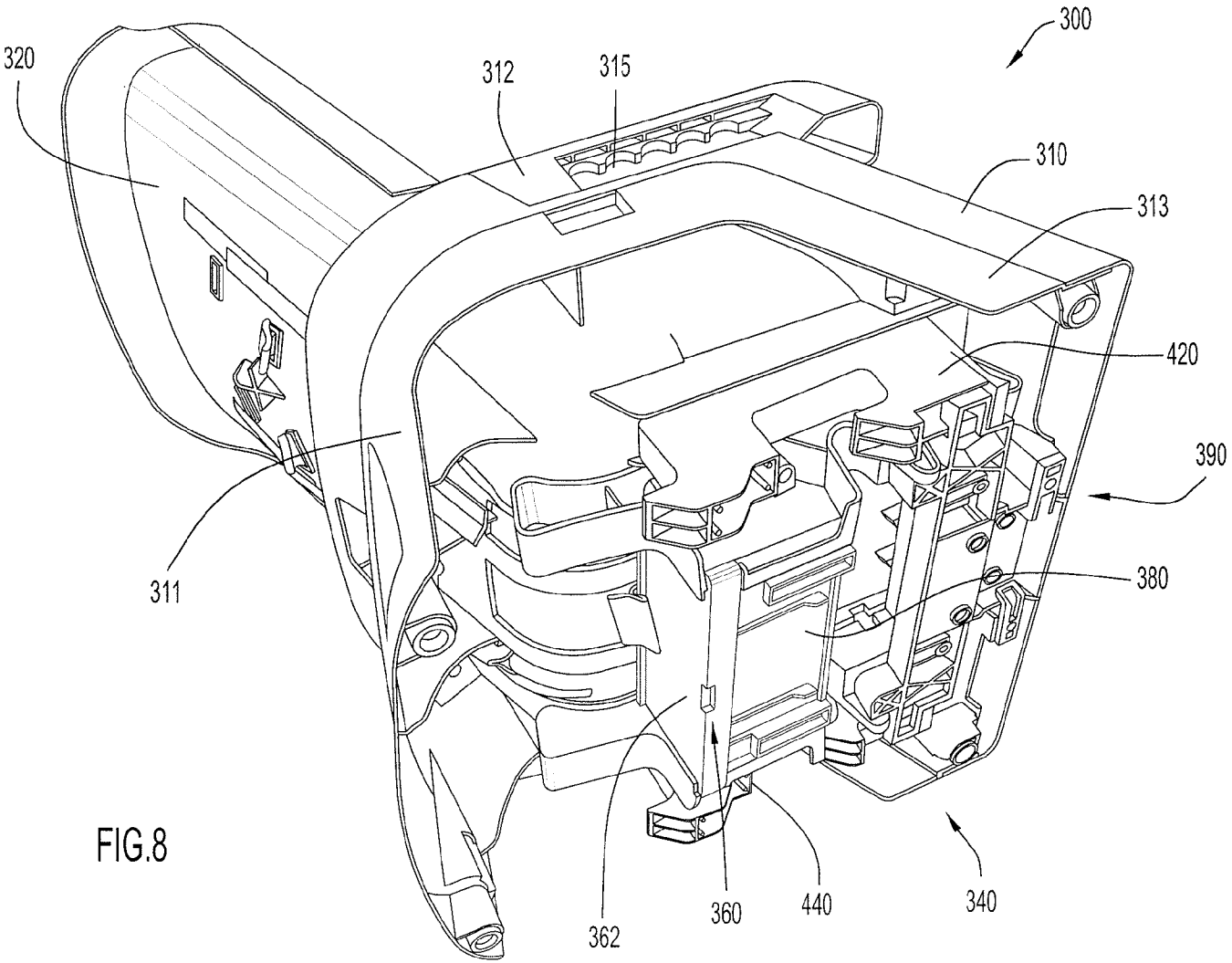
FIG. 8 illustrates a bottom perspective view of the seat portion illustrated in FIG. 7.

Referring to FIG. 8, a bottom perspective view of the seat 300 is illustrated. Arm 312 includes several teeth 315 that the tray 330 can engage. Arm 314 is similarly structured for engagement of the tray 330. The base 310 of the seat 300 includes a rear portion 311 and a front portion 313. A coupling system 340 is located on the bottom of the seat 300. The coupling system 340 can be used to secure the seat 300 to a support other than the frame 200. The coupling system 340 includes a compartment 360 with a housing 362 in which one or more straps or strap portions are placed. The compartment 360 may be referred to alternatively as a chamber or storage compartment. A cover 380 is slidably mounted next to the housing 362 and can be moved from a closed position to an open position to allow access to the straps in the compartment 360.

Also illustrated in FIG. 8 is the mounting portion 390 of the seat 300. The mounting portion 390 is described in greater detail below. In this embodiment, the mounting portion 390 includes latch members 420 and 440.

Figure 9:
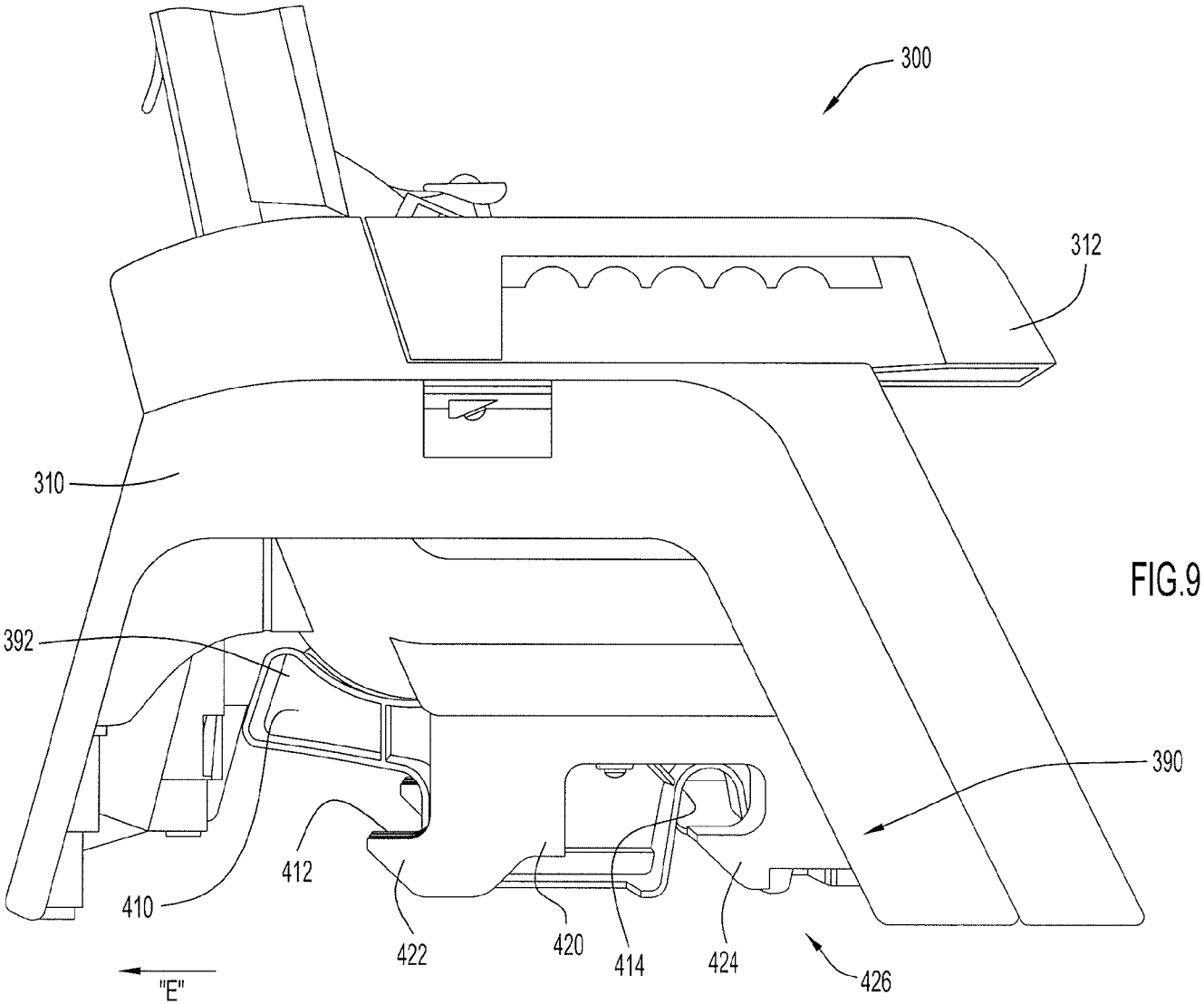
FIG. 9 illustrates a side view of the seat portion illustrated in FIG. 7.

Referring to FIG. 9, a side view of the seat 300 is illustrated. As shown, the mounting portion 390 of the seat 300 is coupled to the base 310. The latch members 420 and 440 of the mounting portion 390 are configured to engage the mounting members 260 and 270 of the frame 200 to couple the seat 300 to the frame 200. The base 310 includes a body 392 with a side portion 410 that has slots or recesses 412 and 414 formed therein. When the seat 300 is mounted on the frame 200, recess 412 receives mounting member 270 and recess 414 receives mounting member 260.

The latch member 420 of the mounting portion 390 is illustrated in FIG. 9. Latch member 420 includes latch portions 422 and 424. Latch member 420 is slidably mounted to the base 310 of the seat 300 and is movable relative thereto. In FIG. 9, the latch member 420 is shown in a locking position 426. Latch member 420 is biased rearwardly into position 426 along the direction of arrow "E" by a biasing mechanism, such as a spring. In this position 426, latch portion 422 is positioned to retain mounting member 270 in recess 412 and latch portion 424 is positioned to retain mounting member 260 in recess 414. Accordingly, latch member 420 couples the seat 300 to the frame 200. As described in detail below, latch member 440 of the mounting portion 390 on the other side of the seat 300 functions in a similar manner.

Figure 10:
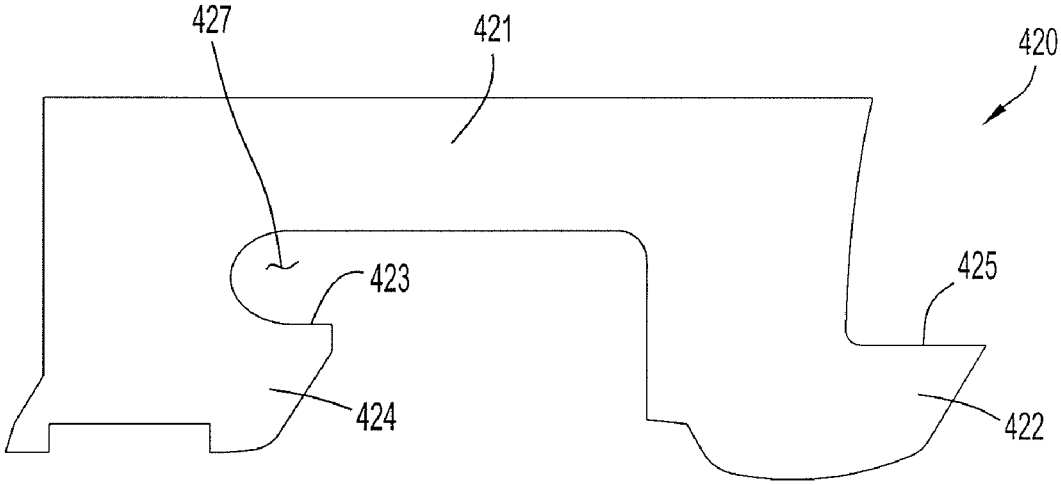
FIG. 10 illustrates a side view of a latch member of the seat portion illustrated in FIG. 7.
Figure 11:
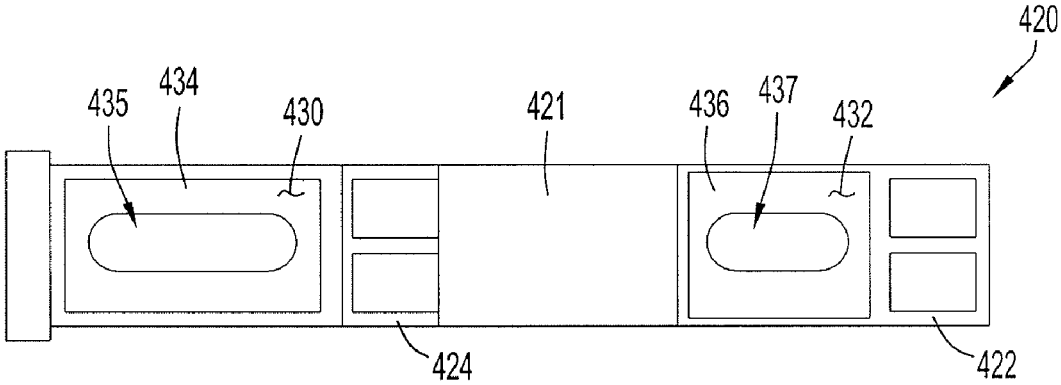
FIG. 11 illustrates a bottom view of the latch member illustrated in FIG. 10.

Referring to FIGS. 10 and 11, side and bottom views of an embodiment of a latch member according to the invention are illustrated. In this embodiment, the latch member 420 includes a body portion 421 and latch portions 422 and 424. While portions 421, 422, and 424 are integrally formed as a molded plastic article, in different embodiments, the portions of the latch member 420 can be formed separately and coupled together. Latch portion 424 has a surface 423 that defines a recess or receptacle 427 in which mounting member 260 is received. Similarly, latch portion 422 has a surface 425 that engages mounting member 270.

As shown in FIG. 11, the latch member 420 includes receptacles 430 and 432 that have lower surfaces 434 and 436 defining slots 435 and 437, respectively. Slots 435 and 437 are configured to receive connectors, such as screws, to mount the latch member 420 to the base 310. The length of the slots 435 and 437 determine the length of travel of the latch member 420.

Figure 12:
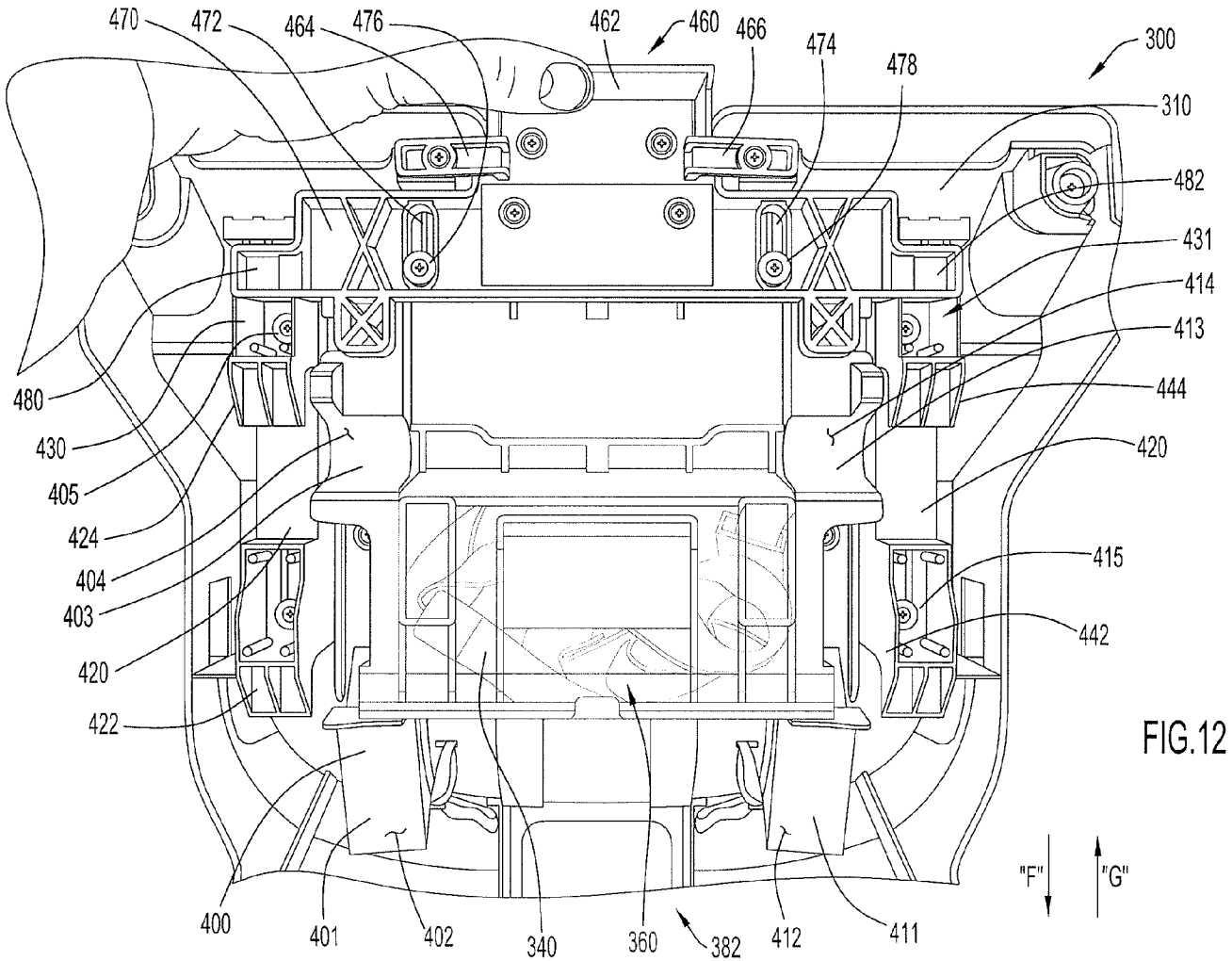
FIG. 12 illustrates a bottom view of the seat portion illustrated in FIG. 7 with the mounting portion in a released configuration.

Referring to FIG. 12, a bottom view of the base 310 of the seat 300 is illustrated. Both of the side portions 400 and 410 and the corresponding latch members 440 and 420, respectively, are illustrated. Side portion 400 includes a rear surface 401 that forms a recess or receptacle 402 that receives mounting member 270 when the seat 300 is placed on the mounting portion 250 of the frame 200. Another surface 403 on the side portion 400 forms a recess or receptacle 404 that receives mounting member 260. Similarly, side portion 410 includes a rear surface 411 that forms a recess or receptacle 412 that receives mounting member 270. Another surface 413 on the side portion 410 forms a recess or receptacle 414 that receives mounting member 260.

The latch members 420 and 440 are slidably coupled to the base 310 via connectors, such as screws. The latch members 420 and 440 are movable along the direction of arrows "F" and "G." Exemplary connectors are illustrated FIG. 12. The connectors 405 and 415 pass through the corresponding slots in the latch members 420 and 440. Also shown in FIG. 12 is the compartment 360 in which the straps 340 are placed.

The movement of the latch members 420 and 440 is described with respect to FIG. 12. The chair 300 includes an actuator assembly 460 with an actuator 462 that can be moved along the direction of arrow "G" by a user. The movement of the actuator 462 is determined by guides 464 and 466 which are coupled to the base 310 by connectors, such as screws. A plate 470 extends along the width of the base 310 is slidably mounted to the base 310 by connectors 476 and 478 that are inserted through slots 472 and 474, respectively. As shown in FIG. 12, when a user pulls on the actuator 462 along the direction of arrow "G," the plate 470 moves along the same direction until the connectors 476 and 478 reach the ends of the slots 472 and 474. When the user releases the actuator 462, a biasing mechanism, such as one or more springs, applies force to the plate 470 and its components to move the plate 470 along the direction of arrow "F."

The plate 470 includes projection portions 480 and 482 at opposite ends that extend from the plate 470. The projection portions 480 and 482 are inserted into the receptacles 430 and 431 of the latch members 420 and 440, respectively. When the plate 470 is moved along the direction of arrow "G," the latch members 420 and 440 move simultaneously in the same direction. Such movement of the latch members 420 and 440 results in the latch portions 422, 424, 442, and 444 moving away from their locking positions.

Figure 13:
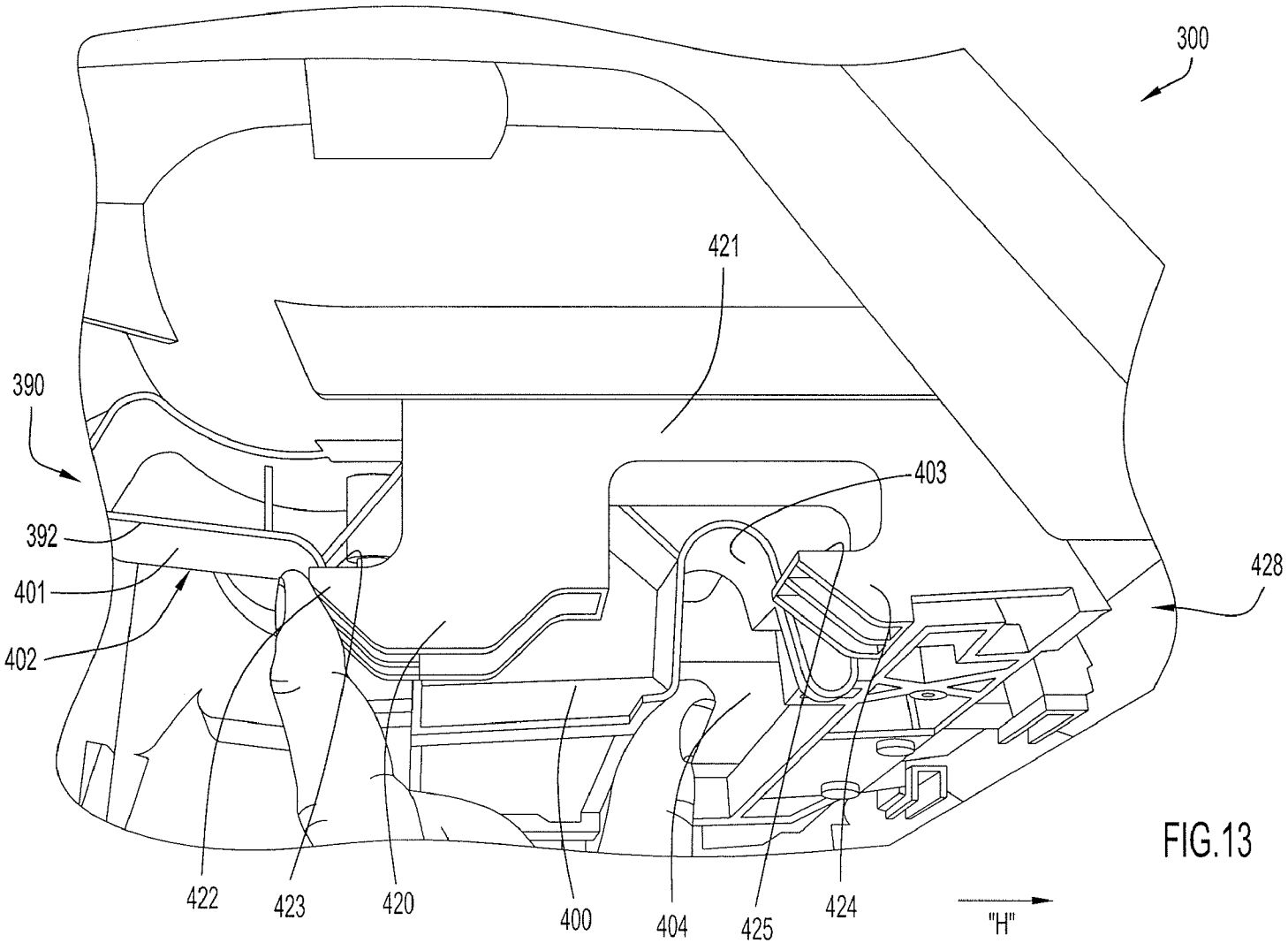
FIG. 13 illustrates a side view of the mounting portion illustrated in FIG. 12.

Referring to FIG. 13, a side view of a portion of the seat 300 is illustrated. In particular, the mounting portion 390 of the seat 300 is shown. As mentioned above, the mounting portion 390 has a body 392 with a side portion 400 having a surface 401 that forms the recess 402 and a surface 403 that forms a recess 404. The latch member 420 includes a body 421 with latch portions 422 and 424 with surfaces 423 and 425, respectively. The latch member 420 is illustrated in FIG. 13 has been moved along the direction of arrow "H" and is in its released position 428. In this position 428, the latch portions 422 and 424 are spaced apart from the corresponding recesses 402 and 404. When the latch portions 422 and 424 are spaced from the recesses 402 and 404, the mounting members 260 and 270 can be removed from the recesses 402 and 404 and the seat 300 can be removed from the frame 200.

Figure 14:
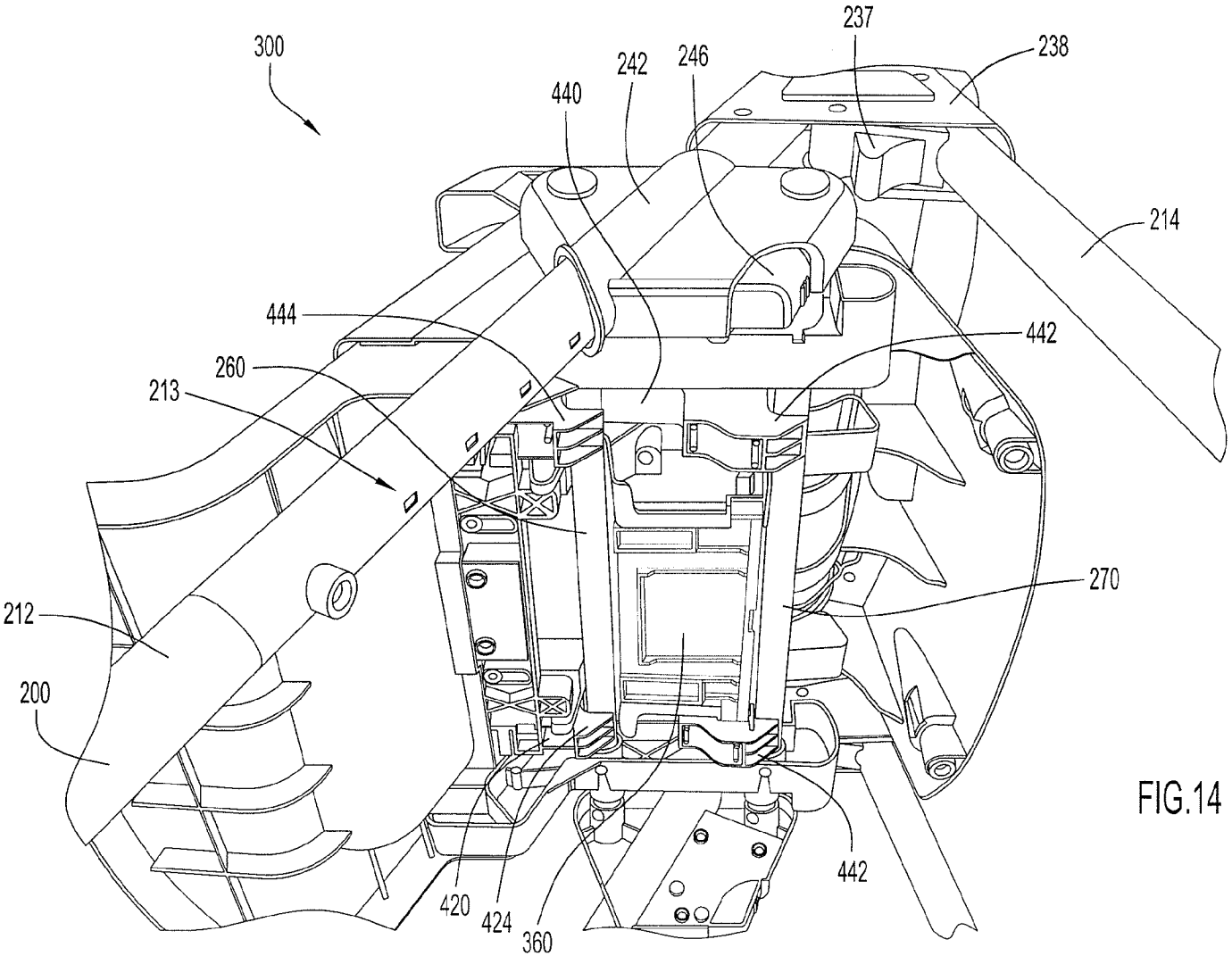
FIG. 14 illustrates a bottom perspective view of the seat portion coupled to the frame according to the invention.

Referring to FIG. 14, a lower perspective view of the seat 300 coupled to the frame 200 is illustrated. As shown, latch members 420 and 440 are used to couple the seat 300 to the frame 200. In particular, latch portions 424 and 444 capture and retain mounting member 260 in recesses 404 and 414. Similarly, latch portions 422 and 442 capture and retain mounting member 270 in recesses 402 and 412. In one embodiment, the compartment 360 is located between the mounting members 260 and 270. In one embodiment, a parent or caregiver can hold the seat 300 above the mounting members 260 and 270 and lower the seat 300 so that mounting member 260 contacts the angled surfaces of latch portions 424 and 444 and mounting member 270 contacts the angled surfaces of latch portions 422 and 442. Such contact by the mounting members 260 and 270 move the latch members 420 and 440 forwardly against the force of a biasing mechanism a sufficient distance so that the mounting members 260 and 270 move in the recesses on the seat base. Once the mounting members 260 and 270 clear the latch portions 422, 424, 442, and 444, the latch members 420 and 440 are biased rearwardly to their locking positions as shown in FIG. 14, thereby retaining the mounting members 260 and 270 as illustrated.

FIG. 14 also shows some of the components of the frame 200. Front member 212 has several holes 213 that can be used with the moving member 242 to secure the moving member 242 in a particular position along the front member 212. Front member 222 has similar holes (not shown). The release mechanism 237 that is used to maintain the rear member 214 in a deployed position relative to the connector 238 is shown. In addition, the release mechanism 246 coupled to the moving member 242 is shown.

Figure 15:
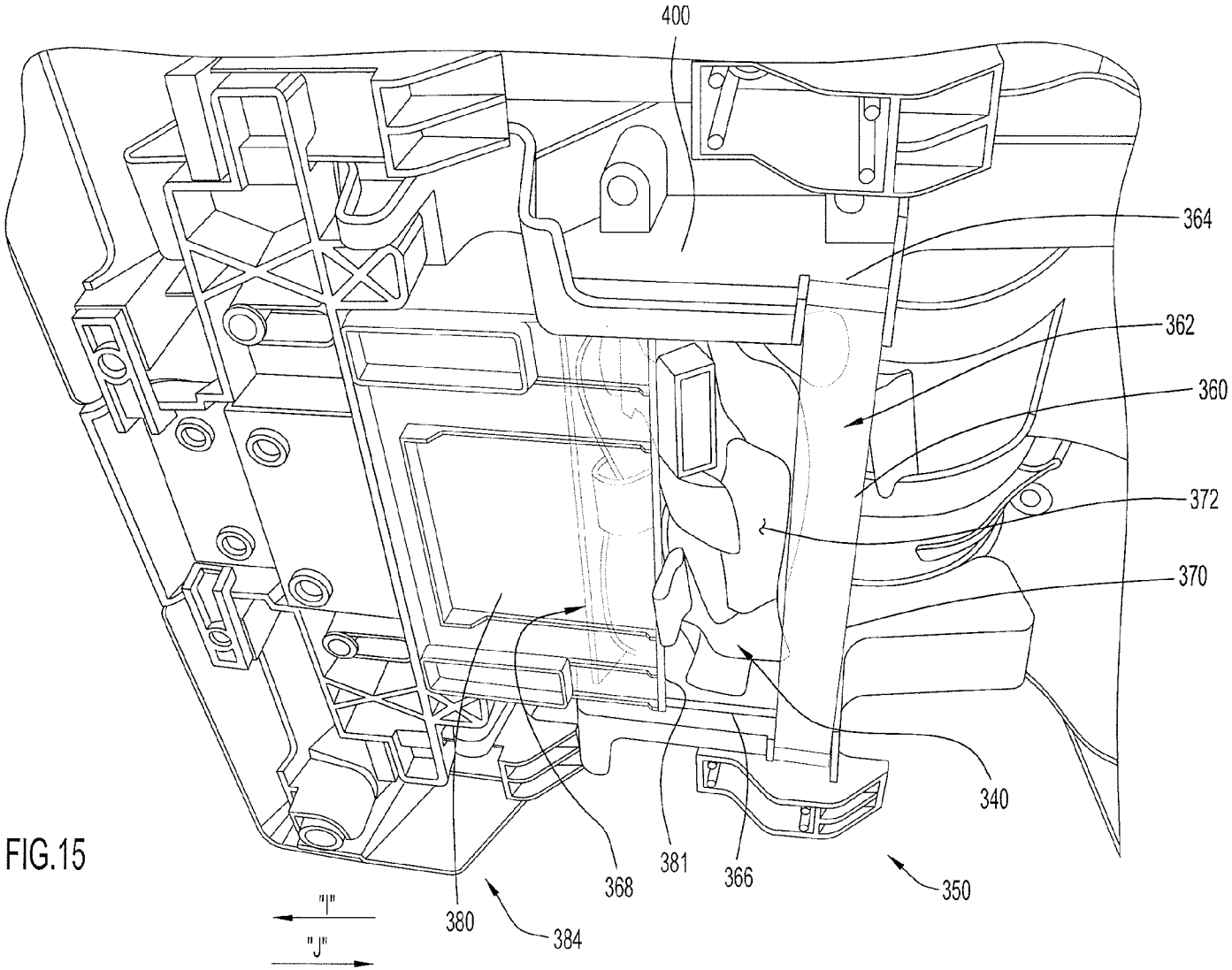
FIG. 15 illustrates a bottom perspective view of the seat portion illustrated in FIG. 7 with the closure member in an opened position.

Referring to FIG. 15, the closure member 380 is illustrated in its opened position 384. The closure member 380 can be moved along the direction of arrow "I" from its closed position 382 (shown in FIG. 12) to its open or opened position 384. Similarly, the closure member 380 can be moved along the direction of arrow "J" from its opened position 384 to its closed position 382. The closure member 380 includes an edge 381 that defines an opening 372 through which the strap system 340 can pass. The strap system 340 is illustrated in a stored mode 350 in FIG. 15. The compartment 360 can be formed by one continuous wall or several walls or wall portions. In this embodiment, the compartment 360 has a housing 362 that includes walls 364, 366, 368, and 370. The side walls of the housing 362 can be part of the side portions 400 and 410. In an alternative embodiment, a portion of the closure member 380 can form one of the walls of the compartment 360.

Figure 16:
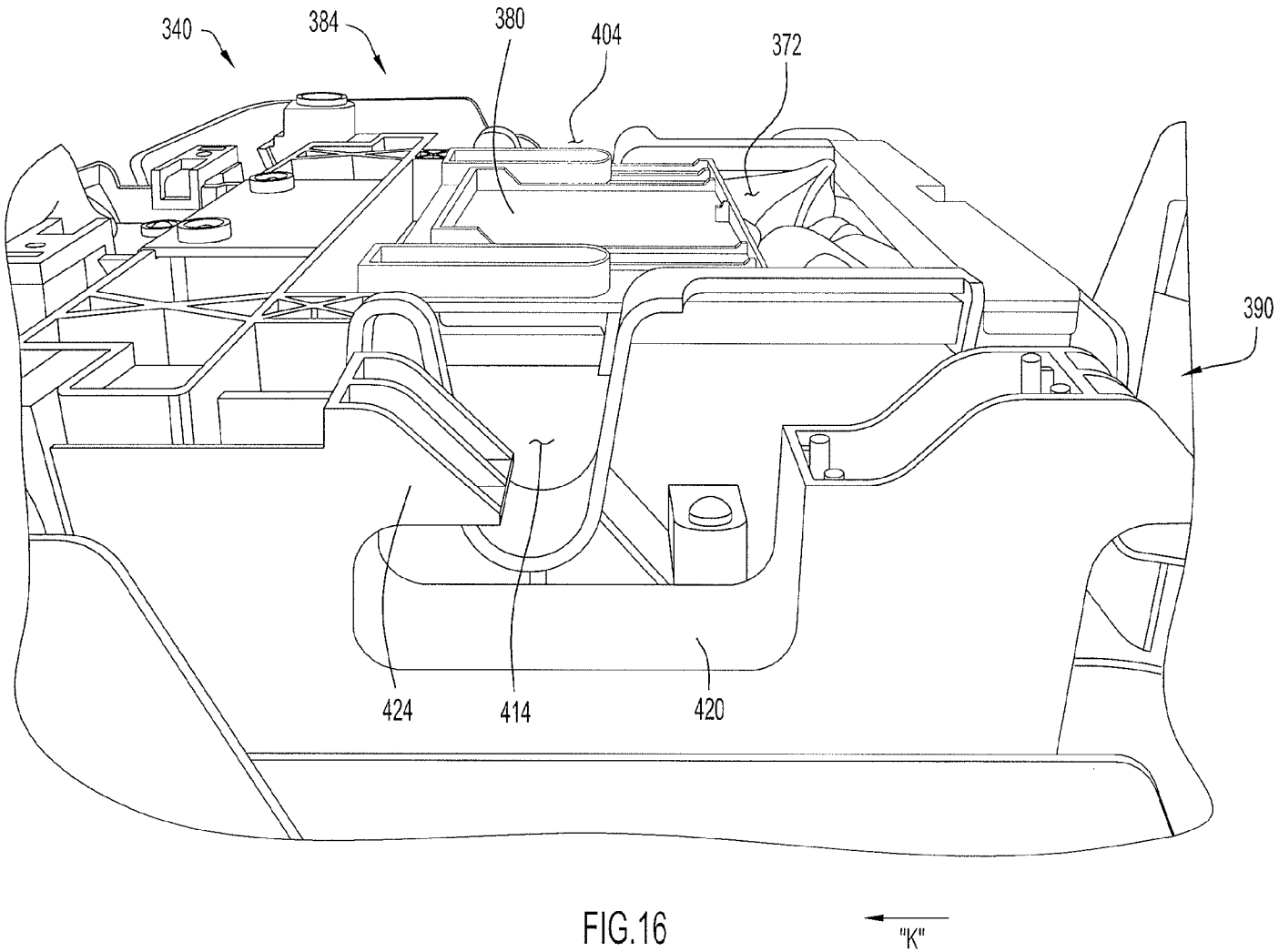
FIG. 16 illustrates a side view of the seat portion illustrated in FIG. 15.

Referring to FIG. 16, the interaction between the mounting portion 390 of the seat 300 and the coupling portion or system 340 is illustrated. The cover or closure member 380 has been moved along the direction of arrow "K" to its opened position 384. When the closure member 380 is moved to its opened position 384, an opening 372 is formed and the closure member 380 blocks recesses 414 and 404 as shown. When closure member 380 blocks recesses 404 and 414, mounting member 260 cannot be inserted into recesses 404 and 414 and the seat 300 cannot be mounted to the frame 200. As illustrated in FIG. 16, the latch portion 424 of latch member 420 cannot be used to engage the mounting member 260. The result is that the mounting portion 390 is rendered inoperable. This arrangement prohibits the seat 300 from being mounted to the frame 200 if the closure member 380 is in its opened position 384. In other words, the seat 300 cannot be coupled to the frame 200 if the strap system 340 has not been stored properly in the compartment 360.

Figure 17:
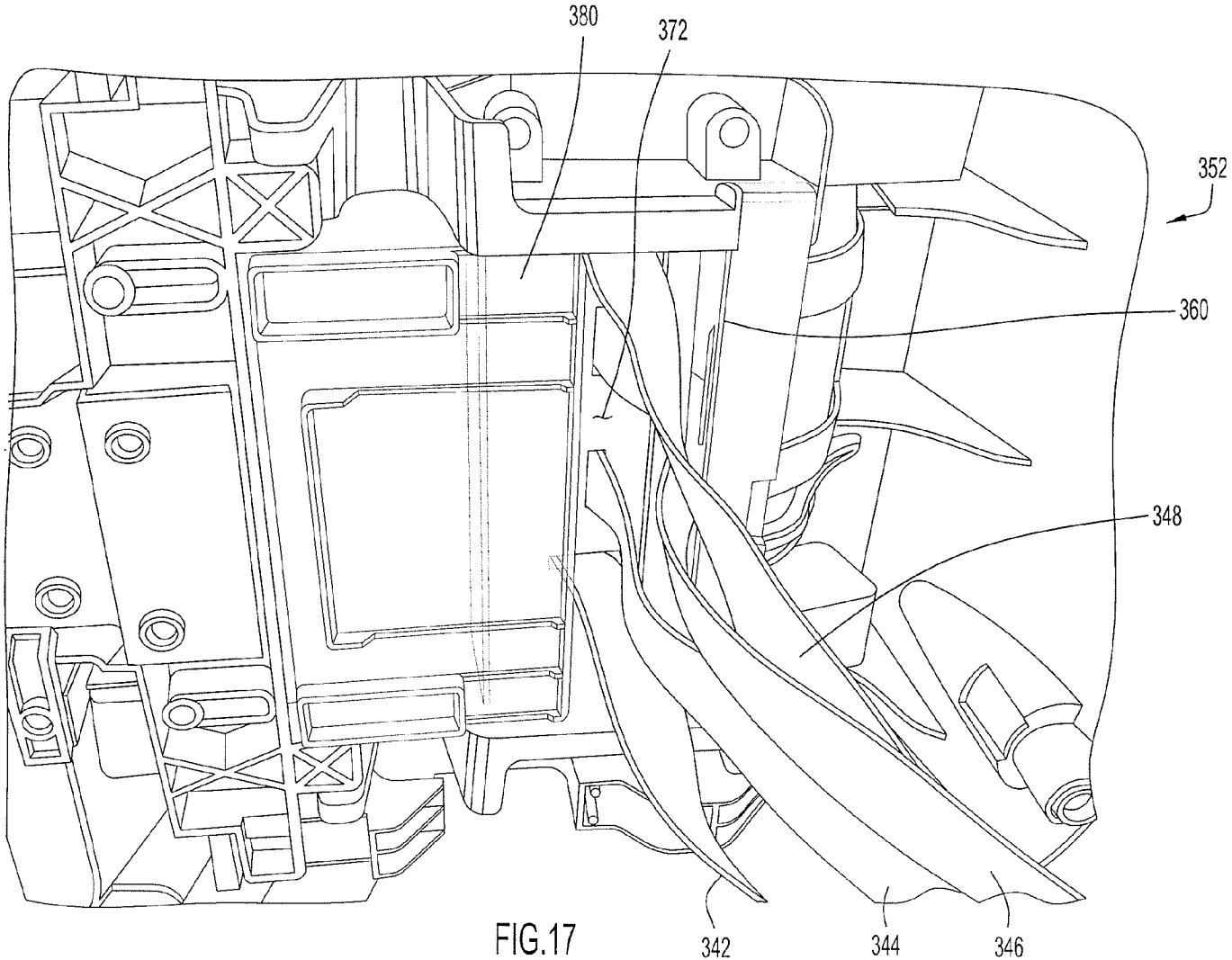
FIG. 17 illustrates a close-up side view of the strap system of the seat portion according to the invention.

Referring to FIG. 17, the closure member 380 of the compartment 360 is moved to its opened position 384, thereby forming an opening 372. The straps or strap portions 342, 344, 346, and 348 are each coupled at one end to the base 310 of the seat 300 and are configured to extend outwardly through the opening 372 in a deployed mode 352 as shown. The straps 342, 344, 346, and 348 can be coupled to the base by an adhesive, a connector, or otherwise inserted into openings formed in the base 310.

Figure 18:
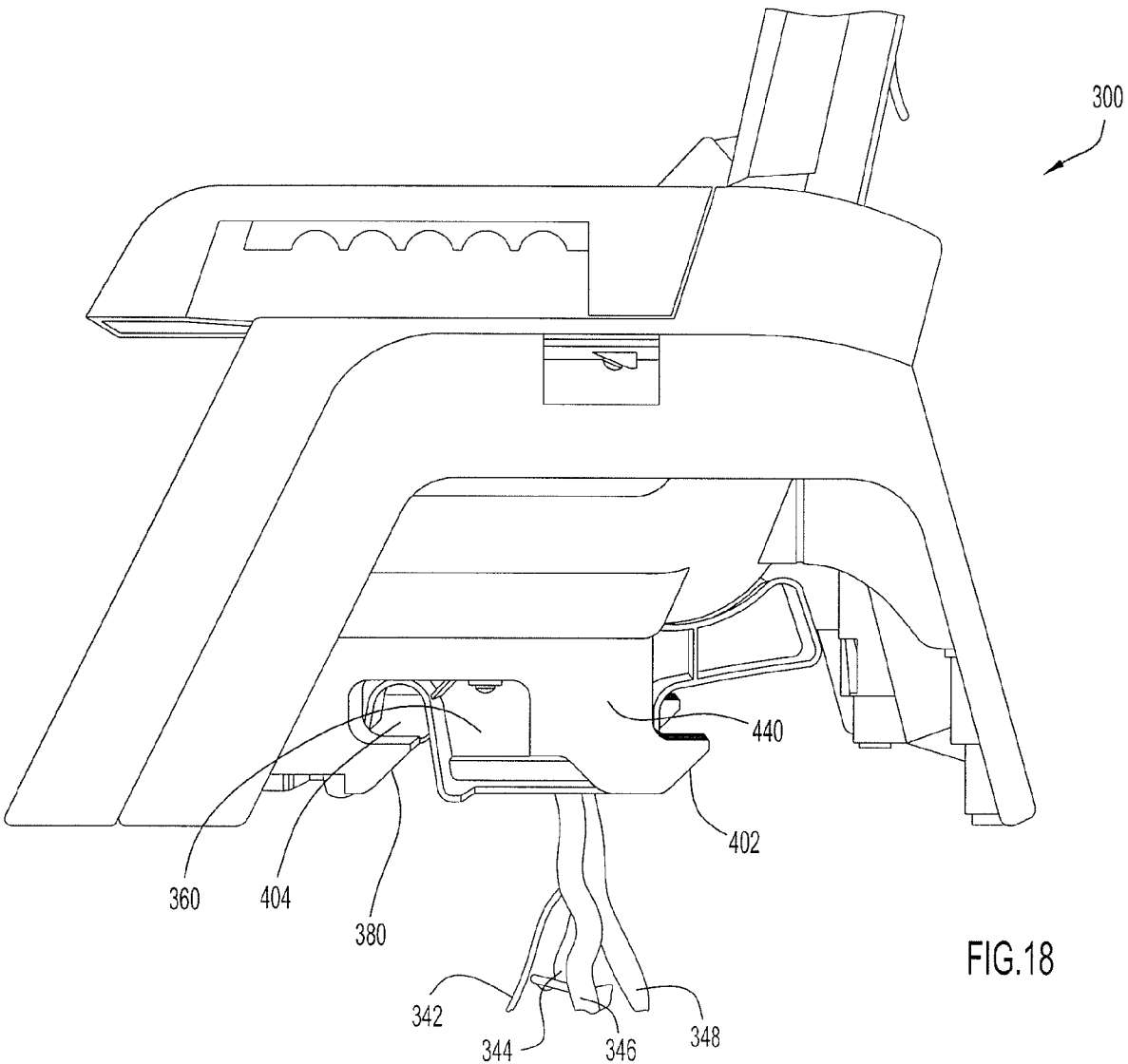
FIG. 18 illustrates a side view of the seat portion illustrated in FIG. 17.

Referring to FIG. 18, a side view of the seat 300 is illustrated. As shown, the straps 342, 344, 346, and 348 are illustrated as extending from the compartment 360. At the free or distal ends of each of the straps 342, 344, 346, and 348 is a buckle portion that is configured to be connected to another one of the buckle portions. The straps are adjustable in length using conventional length adjustment mechanisms. Corresponding pairs of straps can be wrapped around a support, such as a chair or bench, and coupled to each other to secure the seat 300 to the support. In one embodiment, either the straps or the buckle portions of corresponding pairs of straps can be color-coded to facilitate the coupling of the buckle portions and the mounting of the seat 300 by a parent or caregiver to a support.

As shown in FIG. 18, the closure member 380 blocks the recess or slot 404 as previously described. The recess 402 is not blocked, but recess 402 alone is insufficient to couple the seat 300 to the frame 200. The relative positioning of the latch member 440 is illustrated as well. In alternative embodiments, the closure member 380 can be re-oriented so that it blocks the rear recesses (recesses 402 and 412) instead of the front recesses (recesses 404 and 414). In another embodiment, the closure member 380 can be configured so that it blocks at least one of the recesses 402, 404, 412, and 414 and allows the other recesses to be open. As a result, if at least one of the recesses 402, 404, 412, and 414 is blocked, and rendered inoperable, then the seat 300 cannot be properly mounted to the frame 200.

In alternative embodiments, the mounting portion of the seat can vary. For example, the quantity, locations, and configurations of the recesses and slots of the seat mounting portion can vary. The seat may have more than two sets of slots to mount to the frame. Alternatively, the mounting portion of the frame may vary in different embodiments. The mounting portion of the frame may have a single elongate member. Alternatively, the frame mounting portion may have more than to elongate members. In alternative embodiments, the length, size, and configuration of the elongate members may vary. The quantity and length of the straps or strap portions coupled to the seat can vary. Finally, the quantity and configuration of the latch members used to couple the seat to the frame can change in different embodiments. The various components disclosed herein can be made of metal, plastic or any other suitable material.

Thus, it is intended that the invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the invention to any particular orientation or configuration.

What is claimed is:

1. A child seat system comprising:

a frame configured to be placed on a support surface, the frame including a mounting portion; and a seat, the seat being useable in a stand-alone mode and being removably coupleable to the frame in a high chair mode, the seat including:

a strap coupled to the seat, the strap being configured to be used to couple the seat to a support other than the frame;

a compartment, the strap being placeable in the compartment, the compartment having an opening through which the strap can extend;

a mounting portion, the mounting portion of the seat being configured to engage the mounting portion of the frame to couple the seat to the frame; and a closure member being movable relative to the opening of the compartment between a closed position and an open position, the closure member in the closed position covering the opening of the compartment, the closure member in the open position being spaced from the opening and preventing the mounting portion of the seat from engaging the mounting portion of the frame to couple the seat to the frame.

2. The child seat system of claim 1, wherein the closure member is a door that is slidably mounted to the seat, and the door maintains the strap in the compartment when the door is in its closed position.

3. The child seat system of claim 1, wherein the frame includes a first side portion and a second side portion, the mounting portion includes a first mounting member and a second mounting member, each of the first mounting member and the second mounting member being coupled to the first side portion and the second side portion and extending between the first side portion and the second side portion.

4. The child seat system of claim 3, wherein the first mounting member is a first elongate member, the second mounting member is a second elongate member, and the mounting portion of the seat includes a first slot and a second slot, the first slot receiving the first elongate member and the second slot receiving the second elongate member when the seat is mounted on the frame.

5. The child seat system of claim 1, wherein the mounting portion of the seat includes a first side portion and a second side portion, each of the first side portion and the second side portion includes a first slot and a second slot, the closure member blocking the first slots when the closure member is in its open position and the closure member not blocking the first slots when the closure member is in its closed position.

6. The child seat system of claim 5, wherein the mounting portion of the frame includes a first bar and a second bar, the first slots being configured to receive the first bar, and the second slots being configured to receive the second bar.

7. A reconfigurable chair assembly comprising:

a frame portion, the frame portion configured to engage a support surface; and a seat portion, the seat portion being removable from and connectable to the frame portion, the seat portion including:

a chamber with an opening;

a cover movable between an open position spaced from the opening and a closed position covering the opening; and a strap portion, the strap portion being configured to connect the seat portion to an object other than the frame portion, the strap portion being locatable in the chamber and maintained therein by the cover, the seat portion being prevented from being connected to the frame portion unless the strap portion is in the chamber.

8. The reconfigurable chair assembly of claim 7, wherein when the strap portion extends from the chamber, the cover is not movable to its closed position.

9. The reconfigurable chair assembly of claim 8, wherein the seat portion is not connectable to the frame portion when the cover is in its open position.

10. The reconfigurable chair assembly of claim 7, wherein the frame portion includes a mounting portion, the seat portion includes a mounting portion, the mounting portion of the frame portion being configured to engage the mounting portion of the seat portion to couple the seat portion to the frame portion, the cover of the seat portion being positioned proximate to the mounting portion of the seat.

11. The reconfigurable chair assembly of claim 10, wherein the mounting portion of the seat portion is rendered inoperable when the cover is placed in its opened position.

12. The reconfigurable chair assembly of claim 10, wherein the mounting portion of the frame includes at least one elongate member, and the mounting portion of the seat includes at least one recess configured to receive the at least one elongate member.

13. The reconfigurable chair assembly of claim 12, wherein the cover blocks the at least one recess when the cover is placed in its opened position.

14. An infant support structure comprising:

a high chair frame; and a booster seat, the booster seat including a strap configured to couple the booster seat to a support; the booster seat being removably coupleable to the high chair frame, the booster seat having a first configuration in which the booster seat can be coupled to the high chair frame and a second configuration in which the booster seat is prevented, by a portion of the booster seat, from being coupled to the high chair frame.

15. The infant support structure of claim 14, wherein the high chair frame includes a mounting portion and the booster seat includes a mounting portion, the mounting portion of the booster seat being prevented from engaging the mounting portion of the high chair frame when the booster seat is in its second configuration.

16. The infant support structure of claim 15, wherein the booster seat includes a strap system that is configured to store the strap and to allow access to the strap, the strap system storing the strap when the booster seat is in its first configuration and allowing access to the strap when the booster seat is in its second configuration.

17. The infant support structure of claim 16, wherein the strap system includes a storage compartment with a cover, the cover being in a closed position in the first configuration and in an open position in the second configuration.

18. The infant support structure of claim 17, wherein the cover is spaced apart from the mounting portion of the booster seat in the first configuration and blocks the mounting portion of the booster seat in the second configuration.

19. The infant support structure of claim 17, wherein the high chair frame includes a first elongate member and a second elongate member, and the seat includes a first recess configured to receive the first elongate member and a second recess configured to receive the second elongate member.

20. The infant support structure of claim 19, wherein the cover blocks the first recess when the cover is placed in its open position.

* * * * *